United States Patent [19]

Zobel

[11] 4,351,449

[45] Sep. 28, 1982

[54] SELF-LOCKING, UNLOCKING DETACHABLE HAND LEVER CAM SEALED CONTAINER

[76] Inventor: Dwight D. Zobel, 1658 Hyperion, Waterloo, Iowa 50703

[21] Appl. No.: 266,460

[22] Filed: May 22, 1981

[51] Int. Cl.[3] ..... B65D 45/00

[52] U.S. Cl. ..... 220/318; 220/357

[58] Field of Search ..... 220/318, 355–358

[56] References Cited

U.S. PATENT DOCUMENTS 2,632,580 3/1953 Biddlecomfe ..... 220/318

3,868,041 2/1975 Knize ..... 220/318 X

*Primary Examiner*—George T. Hall

*Attorney, Agent, or Firm*—Zarley, McKee, Thomte, Voorhees & Sease

[57] ABSTRACT

A special lock-unlock device for use with sealable, releasable and resealable containers such as paint cans which allows for opening and closing without use of impact forces. This is accomplished by a dual acting cam lug which operates with an associated cam surface adjoining the container cover to cause exertion of pressure to open and unseal the container when the bail is pivoted in one direction and conversely, to close and seal the container when the bail is pivoted in an opposite direction.

6 Claims, 11 Drawing Figures

SELF-LOCKING, UNLOCKING DETACHABLE HAND LEVER CAM SEALED CONTAINER

BACKGROUND OF THE INVENTION

This invention relates to the general area of closure devices for cans such as paint cans. Its particular applicability relates to closures for vessels which must be sealingly closed and thereafter conveniently opened for access to contents of the container.

As most people know, with such cans, and particularly paint cans, once the container is opened and used, it often happens that paint is spilled into the upper rim or groove of the vessel. Thereafter, when the lid is placed on top of the rim to matingly and sealingly join the rim, downward pressure is necessary to cause the seal to become effective. This downward pressure splashes paint out of the rim or lip creating an undesirable situation. Moreover, as the paint drys and then seals, the opening and closing of the lid becomes difficult.

It is a primary object of the present invention to provide a dual acting cam closure which will solve the above referred to problem.

While cam closures have been used in the past for sealing can lids to the vessel, none have heretofore been developed which successfully apply both an opening and a closing force in a manner which is gentle, constant but strong, such that the lid can be successfully locked, unlocked and resealed without splashing the can contents.

Moreover, another objective and advantage of the invention is that one does not need to use any additional tools for opening and closing of the can, but the opening and closing means is wholly self-contained directly on the can.

A yet further object of the invention is to provide a simple and economical lock and unlock device usable for sealing, releasing and resealing can lids in an effective manner even though there might be some of the contents of the can spilled on the can rim.

Other objects and advantages of the structure rely on the particular functional and structural arrangements of the individual components, and will be discussed as appropriate in further portions of the specification. The method and means of accomplishing each of these objectives will be apparent from the detailed description which follows.

SUMMARY OF THE INVENTION

A container characterized by having a sealable, releaseable and resealable lid. The vessel includes an integrally formed upper rim and a cover adapted to overlie the rim for sealing engagement, with the cover at opposite sides having a pair of downwardly extending cam surfaces for receipt of a cam lug when the cover is placed on the lid. Mounted to the vessel adjacent the rim and on opposite sides thereof, are a pair of bail support brackets, each of which rotatably support a cam shaft and a cam lug movable to lock and unlock positions when a bail which is pivotally attached to one end of the cam shaft is moved between a locking and engaging position whereby it engages the cam lug and exerts pressure against the cam surface, causing the lid to be closed, and an unlock open position which exerts pressure in an opposing direction, causing the lid to have upward opening force breaking the seal between the lid and the vessel rim.

DETAILED DESCRIPTION OF THE INVENTION

Figure 1:
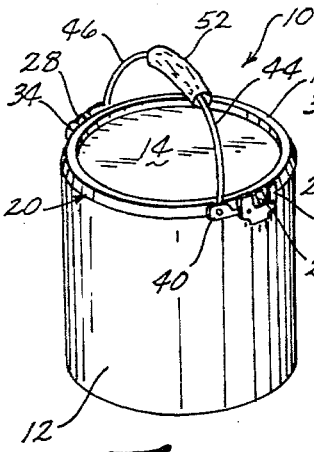
FIG. 1 is a perspective view of the container of the present invention.
Figure 2:
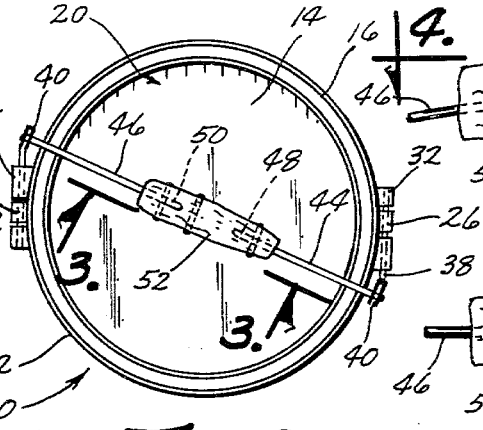
FIG. 2 is a plan view of the container of FIG. 1.
Figure 3:
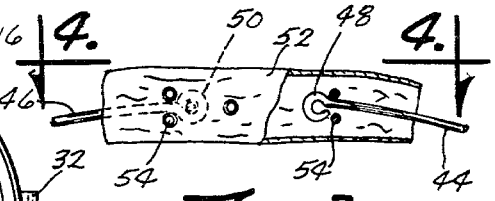
FIG. 3 is an elevated side view, partially in section, showing the bail locking handle.
Figure 11:
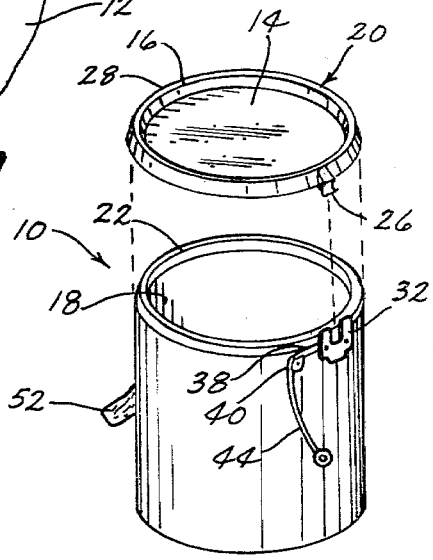
FIG. 11 shows the container in perspective view with the lid released and off.

As can best be seen in FIGS. 1 and 11, the container 10 is comprised of a vessel 12 having a bottom 14 with the upper portion of vessel 12 terminating in an upwardly protruding rim 16 defining an opening 18 into the interior of the vessel. A cover, or in other words, lid, 20 is of conventional construction with the lid 20 having a lip 22 designed for mating receipt with rim 16. On the inside surface of lip 22 for sealing purposes, is sealing gasket 24. Thus, when lip 22 is pressed downwardly into mating relationship against vessel rim 16, gasket 24 sealingly closes the vessel (see FIG. 7).

Figure 7:
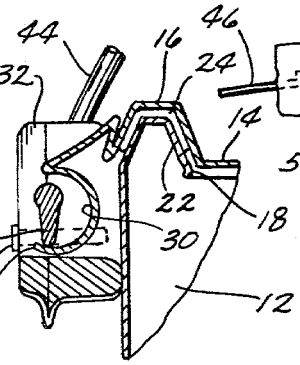
FIG. 7 is a view along line 7—7 of FIG. 6, showing the upper lid cover, and the upper portion of the vessel in locked relationship along with a sectional view through the cam lug and cam riding surface.
Figure 9:
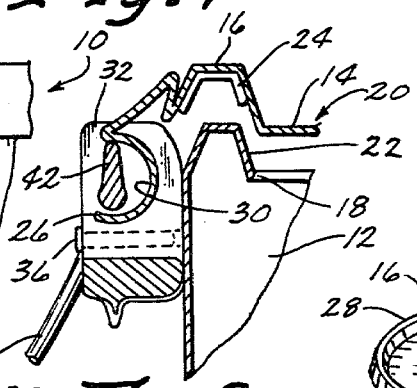
FIG. 9 is a sectional view along line 9—9 showing an unlocked position, similar to the locked position shown in FIG. 7.
Figure 10:
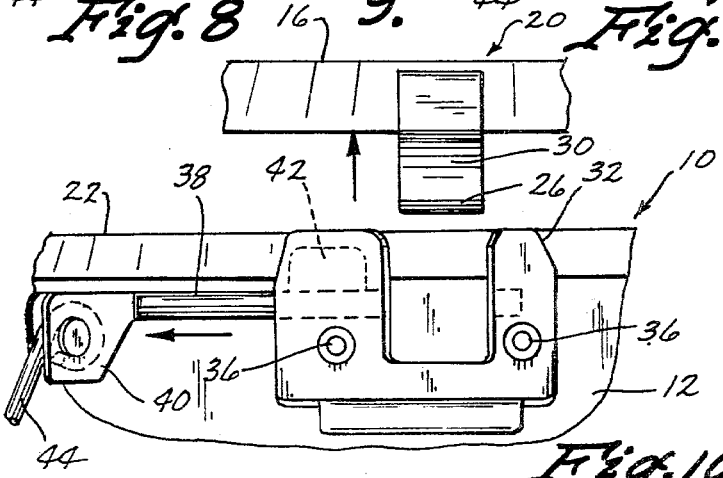
FIG. 10 shows the lid released and off.

As best depicted in FIGS. 7, 9 and 11, lid 20 has fastened thereto at its opposite sides downwardly protruding tabs 26 and 28 which define an interior cam riding surface shaped as a backward "C".

Figure 6:
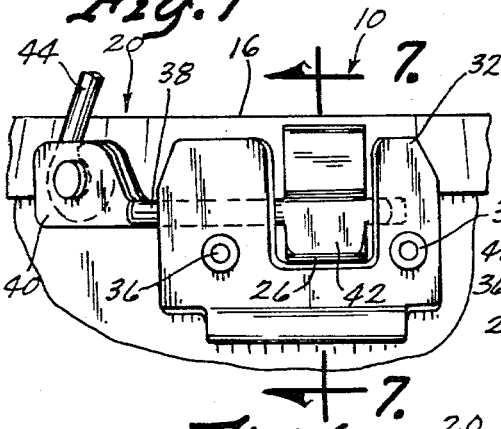
FIG. 6 is an elevated fragmentary view showing the bail support bracket.
Figure 8:
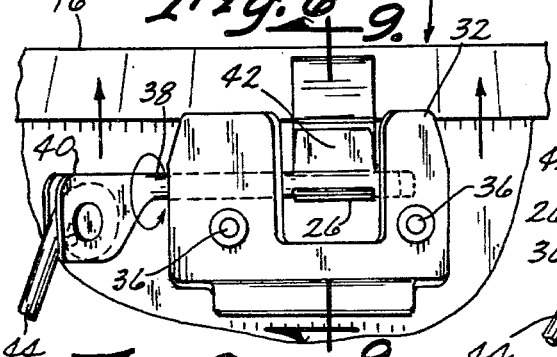
FIG. 8 shows the cam lock in unlocked position.

As depicted in FIGS. 6, 8 and 9, mounted to the opposite sides of the vessel 12 at the upper portion thereof are a pair of bail support brackets 32, 34. Brackets 32 and 34 are U-shaped with the open portion of the U protruding upwardly such that it can receive lid tabs 26 and 28 when the lid is positioned on the can. Brackets 32 and 34 are fastened to the upper portion of the vessel wall by conventional rivets or other fastening means 36.

Rotatably supported by brackets 32 and 34 is a cam shaft 38 which at its outer end terminates in ear 40. Positioned on cam shaft 38 is cam locking lug 42 which is positioned such that it is within open portion of the U-shaped brackets 32 and 34. Thus it can be seen that cam shaft 38 is rotatable transverse to its longitudinal axis to move locking lug 42 from an up and open position as shown in FIGS. 8 and 9 to a down and locked position as shown in FIGS. 6 and 7.

Attached to ear 40 on the respective sides of the can for rotatable movement perpendicular to the longitudinal axis of cam shaft 38 are bails 44 and 46 which extend upward and terminate in hooks 48 and 50.

Figure 4:
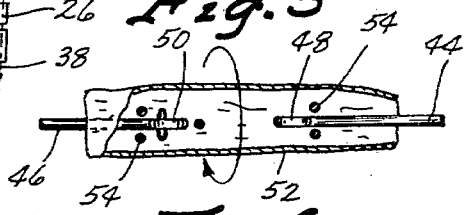
FIG. 4 is a view of the bail locking handle along line 4—4.
Figure 5:
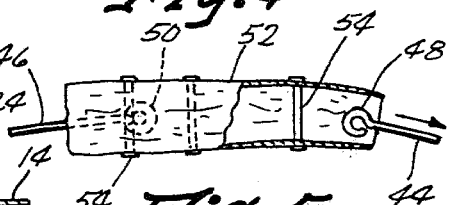
FIG. 5 is a view of the bail locking handle, showing the bails in unlocked position.

Bail handle 52 is fashioned from nylon tubing and has five rivets extending therethrough as depicted in FIG. 4, and as represented by 54. Thus, it can be seen that bails 48 and 50 are retained in the handle enclosure by three of the rivets. Bail handle 52 can be revolved around its longitudinal axis as indicated by the arrow in FIG. 4, such that the handle can be slipped off as indicated in FIG. 5. When the handle is slipped off, bail 44 can be rotated downwardly as depicted in FIG. 9, causing cam shaft 38 to rotate downwardly and cam locking lug 42 to move upwardly exerting pressure against cam surfce 38, causing the lid 24 to be separated from the top portion of the vessel. Conversely, if one desires to seal the container, the bail 44 is moved from its down position to its up position, causing locking lug 42 to rotate to its down position as depicted in FIG. 7. This in turn exerts force against the locking surface 30 in a downward manner, causing the lid tabs 26 and 28 to exert a corresponding force on the lid, thereby achieving its mating and sealing relationship via gasket 24 with the upper rim 16.

It therefore can be seen that a simple, efficient and dual acting cam lug has been provided. It is dual acting because it not only exerts locking force, but also unlocking force, Moreover, the bail is still allowed to swivel in the conventional manner for convenience of the user. Also, the need for additional tools is eliminated and the device therefore accomplishes at least all of the stated objectives.

What is claimed is:

1. A container having a sealable, releaseable and resealable lid comprising:

a vessel including a body wall and a bottom, with the upper portion of said body wall terminating in an integrally formed rim, defining an opening into the vessel, a cover adapted to matingly overlie said rim, having a sealing gasket secured to the cover so as to sealingly engage said rim, said cover at its opposite sides having downwardly and outwardly extending tabs defining an open cam surface adapted for receipt of a cam lug when said cover is placed on said lid, mounted to said vessel adjacent to said rim at opposite sides, a pair of bail support brackets, each of which rotatably support a cam shaft having a cam lug movable between lock and unlock positions, with the outer end of said cam shaft having a protruding ear, a bail pivotally attached to said ear and extending upward for locking engagement into an associated bail handle, whereby unlocking of said bail handle allows the handle to be pivoted downwardly causing said cam shaft and correspondingly said cam lug to move to the unlock position and exert upward opening force on said cover, and conversely, upward pivoting of said bail responsively moves said cam lug to its lock position, causing downward foce on said cover.

2. The device of claim 1 wherein said support brackets are U-shaped and said cam lug matingly fits within the opening thereof.

3. The device of claim 2 wherein said tab defining the cam surface is capable of mating receipt in the opening of said U-shaped brackets.

4. The device of claim 1 wherein said bail handle has associated means for lock and unlock engagement of said bails.

5. The device of claim 4 wherein said bail handle may be rotated to move it from bail locking to bail unlocking positions.

6. The device of claim 1 wherein said tabs define a backward C cam surface.

* * * * *